US012584653B2

(12) United States Patent
Nam et al.

(10) Patent No.: US 12,584,653 B2
(45) Date of Patent: Mar. 24, 2026

(54) AIR CONDITIONER HAVING WATER NOZZLE CLEANING SYSTEM AND WATER NOZZLE CLEANING METHOD USED THEREIN

(71) Applicant: KYUNGDONG NAVIEN CO., LTD., Pyeongtaek-si (KR)

(72) Inventors: Chan Woo Nam, Seoul (KR); Ju Hyuk Lee, Seoul (KR); Moon Yong Park, Seoul (KR); Myoung Seop Lee, Seoul (KR)

(73) Assignee: KYUNGDONG NAVIEN CO., LTD., Pyeongtaek-si (KR)

( * ) Notice: Subject to any disclaimer, the term of this patent is extended or adjusted under 35 U.S.C. 154(b) by 162 days.

(21) Appl. No.: 18/360,041

(22) Filed: Jul. 27, 2023

(65) Prior Publication Data

US 2024/0053054 A1 Feb. 15, 2024

(30) Foreign Application Priority Data

Aug. 12, 2022 (KR) ..... 10-2022-0101376

(51) Int. Cl.
*F24F 13/30* (2006.01)
*F24F 11/70* (2018.01)
*F25B 39/04* (2006.01)

(52) U.S. Cl.
CPC ..... *F24F 13/30* (2013.01); *F24F 11/70* (2018.01); *F25B 39/04* (2013.01); *F25B 2339/041* (2013.01)

(58) Field of Classification Search
CPC .. F24F 13/30; F24F 11/70; F24F 39/04; F24F 2221/22; F24F 5/035; F24F 1/42;
(Continued)

(56) References Cited

U.S. PATENT DOCUMENTS 12,135,142 B2 * 11/2024 Lee ..... F24F 1/0087
2005/0012230 A1 * 1/2005 Kammerzell ..... F24F 6/043 261/98

(Continued)

FOREIGN PATENT DOCUMENTS

KR 10-1609126 B1 4/2016
KR 2018-0115987 A 10/2018

(Continued)

OTHER PUBLICATIONS

Office Action in corresponding KR Application No. 10-2022-0101376, dated Apr. 16, 2025, in 6 pgs.

(Continued)

*Primary Examiner* — Marc E Norman
(74) *Attorney, Agent, or Firm* — Dority & Manning, P.A.

(57) ABSTRACT

An air conditioner having a water nozzle cleaning system for cleaning a water nozzle spraying water to a heat exchanger, and a braking control method used therein are provided, the air conditioner including an evaporator, an expansion valve, a compressor and an evaporative condenser through which refrigerant circulates includes a water supply line including a first water line and a second water line branching from a water supply source and a third water line at which the first water line and the second water line are joined, and configured to supply water to the evaporative condenser; and a water control module including a control unit configured to control the water supply line.

18 Claims, 7 Drawing Sheets

(58) Field of Classification Search
CPC ..... F25B 2339/041; F25B 2600/2513; F25B 2600/2515; F25B 2600/2519
See application file for complete search history.

(56) References Cited

U.S. PATENT DOCUMENTS

| | | | | |
|---|---|---|---|---|
| 2010/0032030 | A1* | 2/2010 | Peterson | C02F 1/325 137/561 R |
| 2020/0378632 | A1* | 12/2020 | Bai | F24F 13/28 |
| 2021/0356221 | A1* | 11/2021 | Blay | F28C 1/14 |
| 2023/0204265 | A1* | 6/2023 | Lee | F24F 11/83 62/304 |

FOREIGN PATENT DOCUMENTS

| | | | |
|---|---|---|---|
| KR | 2022-0074734 | A | 6/2022 |
| KR | 20220082629 | | 6/2022 |
| KR | 20220092119 | A | 7/2022 |

OTHER PUBLICATIONS

Korean Notice of Allowance (w/English translation) for corresponding Application No. 10-2022-0101376, dated Nov. 26, 2025, 4 pages.

* cited by examiner

AIR CONDITIONER HAVING WATER NOZZLE CLEANING SYSTEM AND WATER NOZZLE CLEANING METHOD USED THEREIN

CROSS-REFERENCE TO RELATED APPLICATIONS

This application claims benefit of priority to Korean Patent Application No. 10-2022-0101376 filed on Aug. 12, 2022 in the Korean Intellectual Property Office, the disclosure of which is incorporated herein by reference in its entirety.

TECHNICAL FIELD

The present disclosure relates to an air conditioner having a water nozzle cleaning system which may clean a water nozzle for spraying water into a heat exchanger and a water nozzle cleaning method used therein.

BACKGROUND

A condenser may be a heat exchanger for cooling and liquefying high-temperature, high-pressure refrigerant vapor supplied from a compressor, and may release heat in a refrigeration cycle.

In particular, an evaporative condenser may use a method based on both water cooling and air cooling, wherein water may be sprayed to a tube through which cooling fluid passes, air supplied from a blowing unit may flow to a surface of the tube, and vaporized water vapor may be discharged from a surface of the tube to cool the cooling fluid.

An evaporative cooler may be configured to alternately and repeatedly form a wet channel and a dry channel, and to supply cooled air to a room through a dry channel through heat exchange by evaporation in a wet channel. Specifically, an evaporative cooler may be configured to cool second air passing through the dry channel using latent heat of evaporation of water supplied to first air passing through the wet channel.

Here, it may be important for a water nozzle included in an evaporative condenser and an evaporative cooler to maintain a water supplying angle and a water flow rate to be constant for fine spraying, and for this purpose, the need to increase durability of a nozzle may emerge. However, when a water nozzle receives and sprays water from a water supply source, mineral components (Ca and Mg ions) in tap water may meet HC03 and may change into a solid form of CaCO3 and MgCO3, thereby changing the water supplying angle and the flow rate or clogging the water nozzle, which may be problematic.

SUMMARY

An aspect of the present disclosure is to provide an air conditioner having a water nozzle cleaning system for cleaning a water nozzle spraying water to a heat exchanger, and a braking control method used therein.

An aspect of the present disclosure is to provide an air conditioner and a water nozzle cleaning method used therein.

According to an embodiment of the present disclosure, an air conditioner including an evaporator, an expansion valve, a compressor and an evaporative condenser through which refrigerant circulates includes a water supply line including a first water line and a second water line branching from a water supply source and a third water line at which the first water line and the second water line are joined, and configured to supply water to the evaporative condenser; and a water control module including a control unit configured to control the water supply line, wherein the evaporative condenser includes a condensation module including a fluid passage, a condenser water module configured to spray water supplied through the water supply line above the condensation module, and a blowing module disposed on one side of the condensation module and configured to provide air passing through the condensation module, wherein the water control module includes a first control valve installed in the first water line, a second control valve installed in the second water line, and a water filter, and wherein, when driving of the air conditioner starts, the control unit opens the first control valve, and when driving of the air conditioner ends, the control unit closes the first control valve and opens the second control valve.

According to an embodiment of the present disclosure, an air conditioner including an evaporator, an expansion valve, a compressor, an evaporative condenser through which refrigerant circulates, and an evaporative cooler disposed on an inlet passage through which outdoor air flows in and providing cooled air to the evaporative condenser includes a dehumidifying rotor disposed throughout the inlet passage and the regeneration passage; a heating unit disposed before the dehumidifying rotor on the regeneration passage and configured to regenerate the dehumidifying rotor by heating air passing through the regeneration passage; a water supply line including a first water line and a second water line branching from a water supply source and a third water line at which the first water line and the second water line are joined, and configured to supply water to the evaporative condenser and the evaporative cooler; and a water control module including a control unit configured to control the water supply line, wherein the evaporative condenser includes a condensation module including a fluid passage, a condenser water module configured to spray water supplied through the water supply line above the condensation module, and a blowing unit disposed on one side of the condensation module and configured to provide air passing through the condensation module, wherein the evaporative cooler includes a dry channel through which the air passing through the dehumidifying rotor passes, a wet channel disposed to exchange heat with the dry channel, and a cooler water module configured to provide water to the wet channel, wherein the water control module includes a first control valve installed in the first water line, a second control valve installed in the second water line, and a water filter, and wherein, when driving of the air conditioner starts, the control unit opens the first control valve, and when driving of the air conditioner ends, the control unit closes the first control valve and opens the second control valve.

According to an embodiment of the present disclosure, an air conditioner including an evaporative cooler including a cooler water module in which a plurality of dry channels and a plurality of wet channels are alternately disposed and providing water to the wet channels includes a first water line and a second water line branching from a water supply source, and a third water line at which the first water line and the second water line are joined, and a water control module including a water supply line configured to supply water to the evaporative cooler and a control unit for controlling the water supply line, wherein the air conditioner includes a first passage passing through the wet channel and a second passage passing through the dry channel, the water control module includes a first control valve installed in the first water line, a second control valve installed in the second water line, and a water filter, and when driving of the air conditioner starts, the control unit opens the first control valve, and when the operation of the air conditioner ends, the control unit closes the first control valve, and opens the second control valve.

The air conditioner includes a pressure reducing valve installed in the third water line and configured to adjust pressure of water passing through the third water line to a reference pressure determined by a user; and a pressure gauge configured to measure pressure of water passing through the third water line.

After the first control valve is opened, the pressure reducing valve may control the first measured pressure, the pressure of the water passing through the first water line and the third water line, to be the reference pressure, and the pressure gauge may measure and store the first measured pressure reaching the reference pressure, closes the first control valve, and after the second control valve is opened, the pressure gauge may measure the second measured pressure, the pressure of filtered water passing through the second and third pouring lines, and when the second measured pressure reaches the stored first measured pressure, the control unit may close the second control valve.

After the first control valve is closed, when the third measured pressure, the pressure of residual water passing through the third water line, reaches 0 kgf/cm$^2$, the control unit may open the second control valve.

After a predetermined period of time of 20 seconds or less has elapsed since the second measured pressure reaches the stored first measured pressure, the control unit may close the second control valve.

After the first control valve is opened, the pressure gauge may measure the first measured pressure, the pressure of the water passing through the first water line and the third water line, and the control unit may measure the first cleaning time, the time at which the first measured pressure reaches the reference pressure, and the control unit may close the first control valve, and may open the second control valve during the first cleaning time.

After the first cleaning time has elapsed since opening the second control valve is opened, the control unit may close the second control valve after a predetermined period of time of 20 seconds or less elapses.

When driving of the air conditioner starts, the control unit may determine the second cleaning time satisfying an equation as below, and when driving of the air conditioner ends, the control unit may close the first control valve, and may open the second control valve during the second cleaning time:

$$T2 = \frac{V * p + \frac{\pi}{4} D^2 * l}{1000} \times \frac{1}{lps} \quad \text{Equation}$$

where T2 is a second cleaning time (sec), l is a piping length (cm), D is a piping diameter (cm), V is a water pipe volume (cm$^3$), p is the number of water pipes, lps is a rate of supplying direct water (L/sec).

According to an embodiment of the present disclosure, a water nozzle cleaning method includes a driving starting operation of starting driving of the air conditioner; a water supplying operation of spraying water through a water nozzle to a heat exchanger; a driving terminating operation of terminating driving of the air conditioner; and a cleaning operation of spraying filtered water to the heat exchanger through the water nozzle by passing through a water filter.

The water supplying operation may include measuring and storing the first measured pressure, the pressure of the water moving to the water nozzle side, with the pressure gauge, and the cleaning operation may include measuring second measured pressure, the pressure of the filtered water moving to the water nozzle side, with the pressure gauge, and the cleaning operation may be performed until the first measured pressure and the second measured pressure are equalized.

The cleaning operation may include measuring the third measured pressure, the pressure of the residual water moving to the water nozzle side after the driving terminating operation with the pressure gauge, and may start after the third measured pressure reaches 0 kgf/cm$^2$.

After the first measured pressure and the second measured pressure are equalized, the cleaning operation may be further performed for a predetermined period of time of 20 seconds or less.

The water supplying operation may include measuring the first measured pressure, the pressure of the water moving to the water nozzle side, with the pressure gauge, and the water supplying operation may be performed during the first cleaning time, the time at which the first measured pressure reaches reference pressure determined by a user, and the cleaning operation may be performed for the first cleaning time.

The water supplying operation may be performed for a predetermined period of time of 20 seconds or less after the first cleaning time.

The cleaning operation may be performed during the second cleaning time satisfying an equation below:

$$T2 = \frac{V * p + \frac{\pi}{4} D^2 * l}{1000} \times \frac{1}{lps} \quad \text{Equation}$$

where T2 is a second cleaning time (sec), l is a piping length (cm), D is a piping diameter (cm), V is a water pipe volume (cm$^3$), p is the number of water pipes, lps is a rate of supplying direct water (L/sec).

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
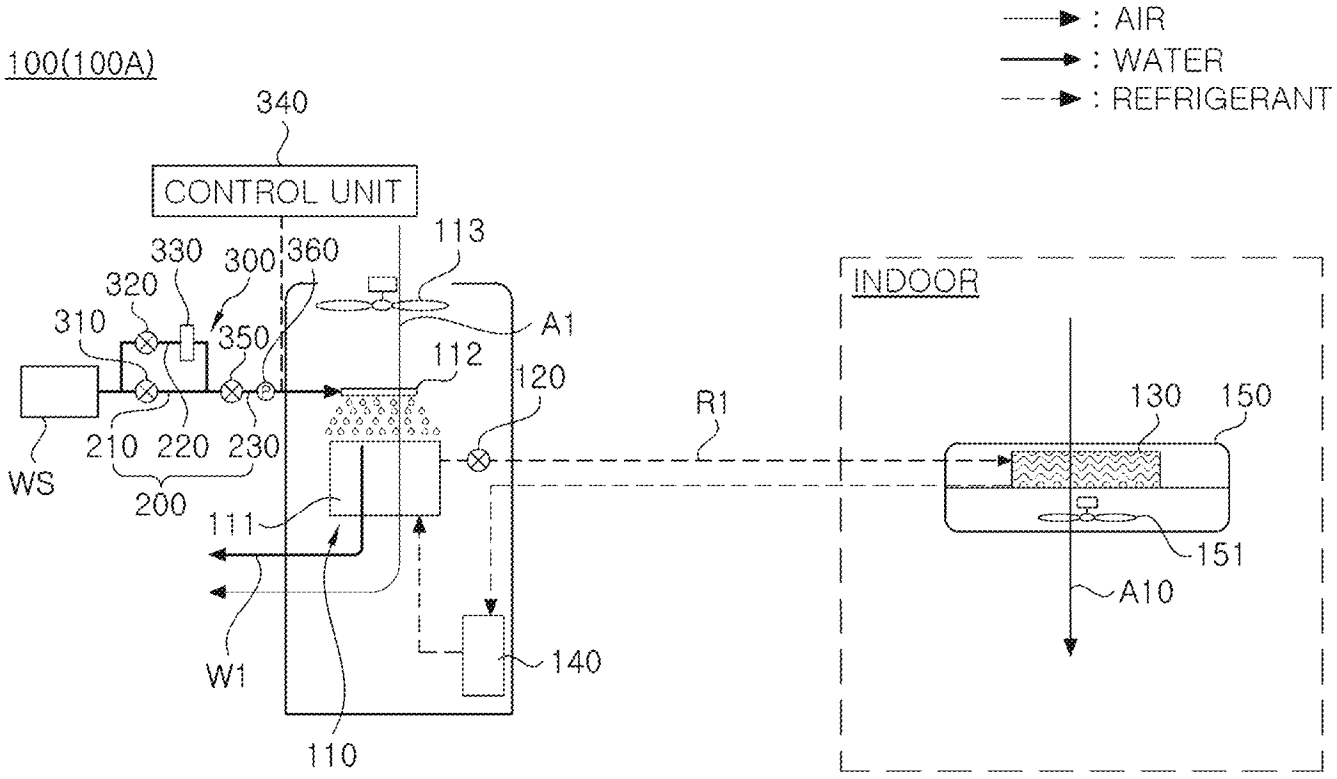
FIG. 1 is a diagram illustrating an air conditioner according to a first embodiment of the present disclosure.

Hereinafter, embodiments of the present disclosure will be described with reference to the attached drawings.

Various embodiments will be described with reference to accompanying drawings. However, this may not necessarily limit the scope of the embodiments to a specific embodiment form. Instead, modifications, equivalents and replacements included in the disclosed concept and technical scope of this description may be employed. Throughout the specification, similar reference numerals are used for similar elements.

In the embodiments, the term "connected" may not only refer to "directly connected" but also include "indirectly connected" by means of an adhesive layer, or the like. Also, the term "electrically connected" may include both of the case in which elements are "physically connected" and the case in which elements are "not physically connected." Further, the terms "first," "second," and the like may be used to distinguish one element from the other, and may not limit a sequence and/or an importance, or others, in relation to the elements. In some cases, a first element may be referred to as a second element, and similarly, a second element may be referred to as a first element without departing from the scope of right of the embodiments.

The air conditioner 100 according to an embodiment may include an air conditioner 100A according to a first embodiment, an air conditioner 100B according to a second embodiment, and an air conditioner 100C according to a third embodiment.

FIG. 1 is a diagram illustrating an air conditioner 100A according to a first embodiment. As illustrated in FIG. 1, the air conditioner 100A according to the first embodiment may include an evaporative condenser 110 in which compressed refrigerant is condensed, an expansion valve 120 in which the refrigerant passing through the evaporative condenser 110 expands, an evaporator 130 in which the refrigerant passing through the expansion valve 120 is evaporated, and a compressor 140 compressing the refrigerant passing through the evaporator 130. The refrigerant may pass through the evaporative condenser 110, the expansion valve 120, the evaporator 130 and the compressor 140 and may form a refrigerant cycle R1.

Here, the evaporative condenser 110 may include a condensation module 111 including a fluid passage, a condenser water module 112 spraying water passing through the condensation module 111 above the condensation module 111, and a blowing module 113 disposed on one side of the condensation module 111 and providing air passing through the condensation module 111. The evaporative condenser 110 may be installed in an outdoor unit spatially separated from an indoor area, and an air passage A1 in which air is suctioned in from the outside by the blowing module 113 and passes through the condensation module 111, the temperature thereof is increased and the air is discharged, and a water supply passage W1 and the refrigerant cycle R1 connected to the water supply source WS, sprayed to the condensation module 111 by the condenser water module 112, and drained below the condensation module 111 may pass through the condensation module 111, and the refrigerant may be condensed by the air in the air passage A1 and the water in the water supply passage W1. Meanwhile, the evaporator 130 through which the refrigerant cycle R1 passes may be disposed in the indoor unit 150, the indoor unit 150 may include a blower 151, and indoor air may pass through the evaporator 130 and may form an indoor circulation passage A10 supplied to the room again by the blower 151.

Here, the condensation module 111 may exchange heat with water and air while the refrigerant passes through a three-dimensional structure formed in the third direction, the extension direction of the header, the extension direction of the connection tube, and the stacking direction of the header heat. Accordingly, even when the volume is occupied, more heat exchange may be performed such that cooling efficiency may be improved. However, an embodiment thereof is not limited thereto, and the condensation module 111 may be applied with a condenser structure using water evaporation.

The air conditioner 100A according to the first embodiment may include a water supply line 200 for transferring water supplied from a water supply source WS to the evaporative condenser 110 and a water control module 300 for controlling the water supply line 200. The water supply line 200 may include a first water line 210 and a second water line 220 branching from the water supply source WS, and a third water line 230 joined to the first water line 210 and the second water line 220 and connected to the condenser water module 112. The water control module 300 may include a first control valve 310 installed in the first water line 210, a second control valve 320 installed in the second water line 220, and a water filter 330, and may further include a control unit 340 controlling the water supply line 200. In this case, the control unit 340 may be installed in the third water line 230, and an embodiment thereof is not limited thereto as long as the control unit 340 may control the water supply line 200.

In this case, the control unit 340 may open the first control valve 310 when the driving of the air conditioner 100A according to the first embodiment starts, and when the driving of the air conditioner 100A ends, the control unit 340 may close the first control valve 310 and may open the second control valve 320. That is, when the driving of the air conditioner 100A starts, water may be supplied to the air conditioner 100A from the water supply source WS through the first water line 210 and the third water line 230, and the water may move to the side of the condenser water module 112 and may be sprayed to the condensation module 111. In this case, the water may pass through the water supply passage W1 discharged below the condensation module 111, may meet the air of the air passage A1 and may condense the refrigerant.

Furthermore, as illustrated in FIG. 1, in the air conditioner 100A according to the first embodiment, the water control module 300 may further include a pressure reducing valve 350 and a pressure gauge 360. The pressure reducing valve 350 may be installed in the third water line 230 and may adjust pressure of water passing through the third water line 230 to a reference pressure determined by a user, and the pressure gauge 360 may measure the pressure of water passing through the third water line 230. The water pressure may be measured. In this case, the reference pressure may refer to the amount in which the water supplied to the water nozzle (not illustrated) through the water supply line 200 may be appropriately sprayed, and may refer to a pressure at which fine spraying may be possible. Accordingly, cleaning of the water nozzle (not illustrated) may be easily performed by controlling the filtered water to have an appropriate pressure without damaging the water nozzle (not illustrated).

Meanwhile, when the driving of the air conditioner 100A ends, water may be supplied from the water supply source WS through the second water line 220 and the third water line 230 to the air conditioner 100A, and the water may pass through the water filter 330 installed in the second water line 220, the filtered water may move to the condenser water module 112 and may be sprayed to the condensation module 111. The filtered water may pass through the water supply passage W1 and may pass through the water nozzle (not illustrated) of the condenser water module 112 and may wash foreign substances such as $CaCO_3$ and $MgCO_3$ clogging the water nozzle (not illustrated) of the condenser water module 112 and may allow the substances to flow down together. In this case, the water filter 330 may be configured as a membrane filter for removing hard materials forming foreign substances such as $CaCO_3$ and $MgCO_3$, and is not limited thereto as long as the filter may filter hard materials forming foreign substances.

Accordingly, the driving of the air conditioner 100A may end, and as the cleaning process of the water nozzle (not illustrated) may be performed once more, such that a water supply angle and a water flow rate for fine spraying may be maintained to be constant, and durability of the water nozzle (not illustrated) may increase.

Figure 2:
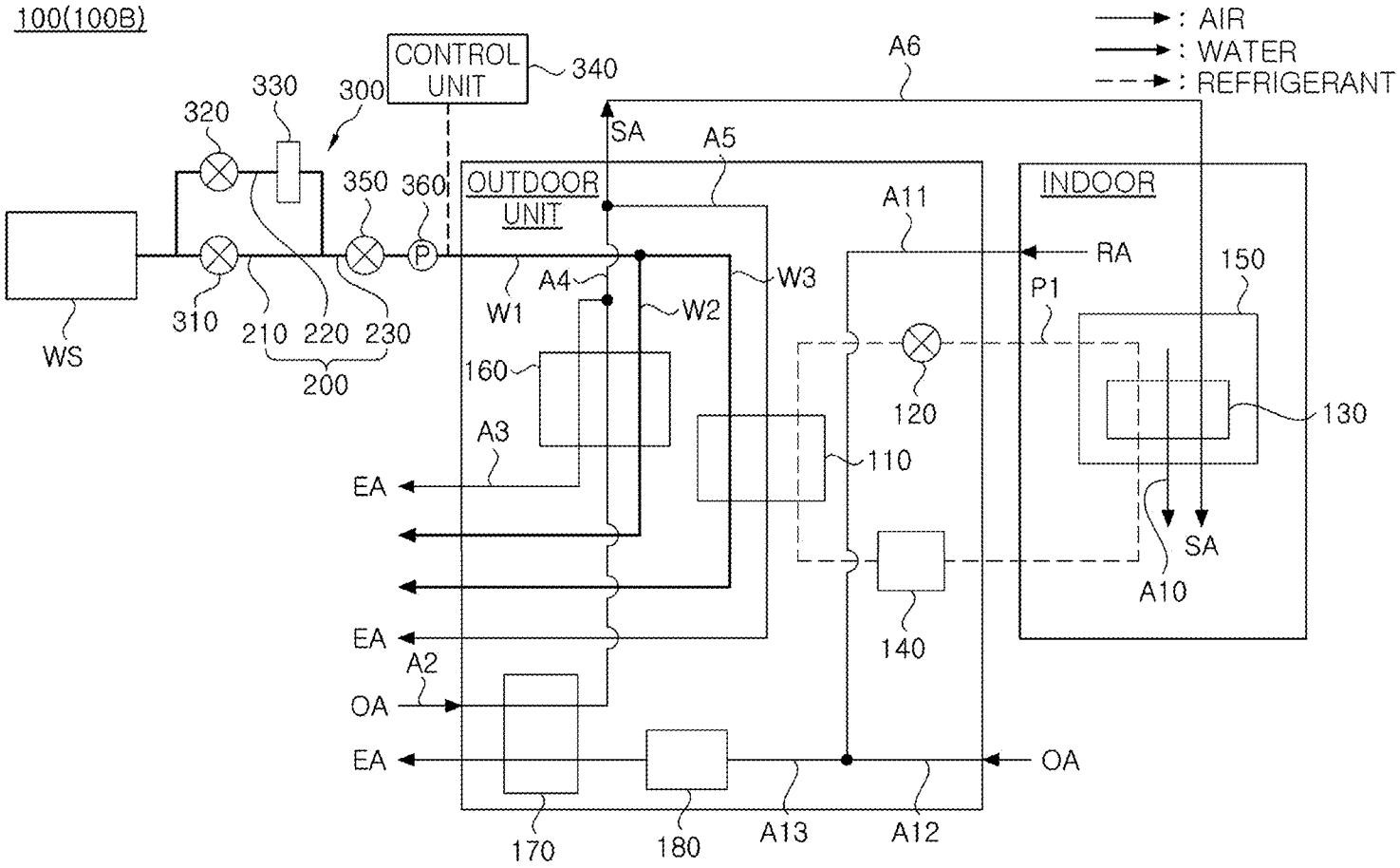
FIG. 2 is a diagram illustrating an air conditioner according to a second embodiment of the present disclosure.

FIG. 2 is a diagram illustrating an air conditioner according to a second embodiment. Hereinafter, an air conditioner 100B according to the second embodiment will be described with reference to FIG. 2, and the air conditioner 100B according to the second embodiment may include components corresponding to those of the air conditioner 100A according to the first embodiment, and the corresponding components will be described by being denoted by the same terms and reference numerals, and overlapping descriptions will not be provided and differences will be mainly described. Also, the air conditioner 100B according to the second embodiment may be described in greater detail by disclosed in the patent application No. 10-2022-0082629A.

As illustrated in FIG. 2, the air conditioner 100B according to the second embodiment may include an evaporative condenser 110, an expansion valve 120, an evaporator 130, a compressor 140, an evaporative cooler 160, a dehumidifying rotor 170 and a heating unit 180. The air conditioner 100B may include a refrigerant cycle R1 in which refrigerant circulates, and in the refrigerant cycle R1, the compressor 140, the evaporative condenser 110, and the expansion valve 120 may be disposed in an outdoor unit, and the evaporator 130 may be disposed in an indoor unit 150 and may be disposed in the indoor unit 150 or in another air conditioning space except for the evaporative condenser 110. The outdoor unit may include the evaporative cooler 160 disposed on the inlet passage A2 through which outdoor air flows in, including a dry channel and a wet channel, and cooling the air passing through the dry channel, the dehumidifying rotor 170 disposed before the evaporative cooler 160 on the inlet passage A2 and dehumidifying the incoming air, and a heating unit 180 disposed before the dehumidifying rotor 170 in regeneration passages A12 and A13 through which air for regenerating the dehumidifying rotor 170 passes and heating air.

The evaporative cooler 160 may include a dry channel through which air requiring cooling passes and a wet channel adjacent to the dry channel. In the wet channel, evaporation of water sprayed from a cooler water module (not illustrated) may occur, and the wet channel may exchange heat with the channel. Generally, the evaporative cooler 160 may alternately dispose the dry channel and the wet channel, and the cooler water module (not illustrated) may be disposed above the wet channel, may provide water to the wet channel, and may include a cooler blowing module (not illustrated) in an upper portion or a lower portion thereof and may generate a flow. The evaporative cooler 160 is not limited thereto as long as the evaporative cooler 160 may use evaporation, and other structures may be applied.

The dehumidifying rotor 170 may be disposed throughout the regeneration passages A12 and A13 and the inlet passage A2, and the dehumidifying rotor 170 may absorb moisture in the inlet passage A2 through the rotating rotor, and may operate by discharging the absorbed moisture in the regeneration passages A12 and A13. Referring to FIG. 2, the inlet passage A2 may branch into an indoor supply passage A6 connected to the room, a condenser supply passage A5 connected to the evaporative condenser 110, and a cooler supply passage A3 connected to the wet channel of the evaporative cooler 160. After inlet passage A2 branches to the cooler supply passage A3, the inlet passage A2 may branch to the condenser supply passage A5 and the indoor supply passage A6 through a connection passage A4. In this case, the indoor supply passage A6 may be connected to the indoor unit 150, may pass through the evaporator 130, and may be supplied to an indoor area in a cooled state. However, an embodiment thereof is not limited thereto, and the evaporator 130 may pass through the indoor circulation passage A10 and the indoor supply passage A6 may be supplied from the ceiling to the room.

The air conditioner 100B according to the second embodiment may include a discharge passage A11 for discharging indoor air externally in an amount corresponding to the amount of air supplied to the room, and the discharge passage A11 may be joined to the regeneration passage A12 and may become a combined regeneration passage A13. The regeneration passages A12 and A13 may be heated while passing through the heating unit 180, may regenerate the dehumidifying rotor 170, and may be discharged externally.

The water supply passage W1 connected to the water supply source WS may be branched into a water supply passage W2 directed to the evaporative condenser 110 and a water supply passage W3 directed to the evaporative cooler 160, and water providing latent heat for condensing the refrigerant passing through the evaporative condenser 110 and water providing latent heat for cooling the air passing through the evaporative cooler 160 may be supplied to the water supply passage W1 by the water supply passages W2 and W3. Thereafter, each body of water passing through the evaporative condenser 110 and the evaporative cooler 160 may be drained externally.

An air conditioner 100B according to a second embodiment may include a water supply line 200 for transferring water supplied from a water supply source WS to the evaporative condenser 110 and the evaporative cooler 160 and a water control module 300 for controlling the water supply line 200. The water supply line 200 and the water control module 300 may correspond to the components of the air conditioner 100A described in the aforementioned first embodiment, and in the air conditioner 100B according to the second embodiment, the third water line 230 may pass through the water supply passage W1, may be branched into the water supply passages W2 and W3 and may supply water to the evaporative condenser 110 and the evaporative cooler 160, respectively.

That is, when the driving of the air conditioner 100B starts, the control unit 340 may open the first control valve 310, and accordingly, water may be supplied to the air conditioner 100B from the water supply source WS through the first water line 210 and the third water line 230, and the water may pass through the water supply passage W1, may be branched to the water supply passages W2 and W3, and may be supplied to the evaporative condenser 110 and the evaporative cooler 160, respectively.

Meanwhile, when the driving of the air conditioner 100B ends, the control unit 340 may close the first control valve 310 and may open the second control valve 320, and accordingly, water may be supplied to the air conditioner 100B from the water supply source WS through the second water line 220 and the third water line 230, and the water may pass through the water filter 330 installed in the second water line 220, and the filtered water may pass through the water supply passages W2 and W3, respectively, and may be supplied to the evaporative condenser 110 and the evaporative cooler 160, respectively. The filtered water may wash foreign substances such as $CaCO_3$ and $MgCO_3$ clogging the water nozzle (not illustrated) of the condenser water module (not illustrated) and the cooler water module (not illustrated) and may flow down together with the foreign substances.

Furthermore, as illustrated in FIG. 2, in the air conditioner 100B according to the second embodiment, the water control module 300 may further include a pressure reducing valve 350 and a pressure gauge 360. The pressure reducing valve 350 may be installed in the third water line 230 and may adjust pressure of water passing through the third water line 230 to a reference pressure determined by a user, and the pressure gauge 360 may measure pressure of water passing through the third water line 230. In this case, the reference pressure may refer to an amount at which the water supplied to the water nozzle (not illustrated) through the water supply line 200 may be appropriately sprayed, and may refer to a pressure at which fine spraying may be possible. Accordingly, cleaning of the water nozzle (not illustrated) may be easily performed by controlling the filtered water to an appropriate pressure without damaging the water nozzle (not illustrated).

Accordingly, the driving of the air conditioner 100B ends, and as the cleaning process of the water nozzle (not illustrated) of the evaporative condenser 110 and the evaporative cooler 160 is performed once more, the water supply angle and the water flow rate for fine spraying may be maintained to be constant, and durability of the water nozzle (not illustrated) may be improved. In this case, the water nozzle (not illustrated) may be applied to both the evaporative condenser 110 and the evaporative cooler 160, and an embodiment thereof is not limited thereto as long as the water is finely sprayed.

Figure 3:
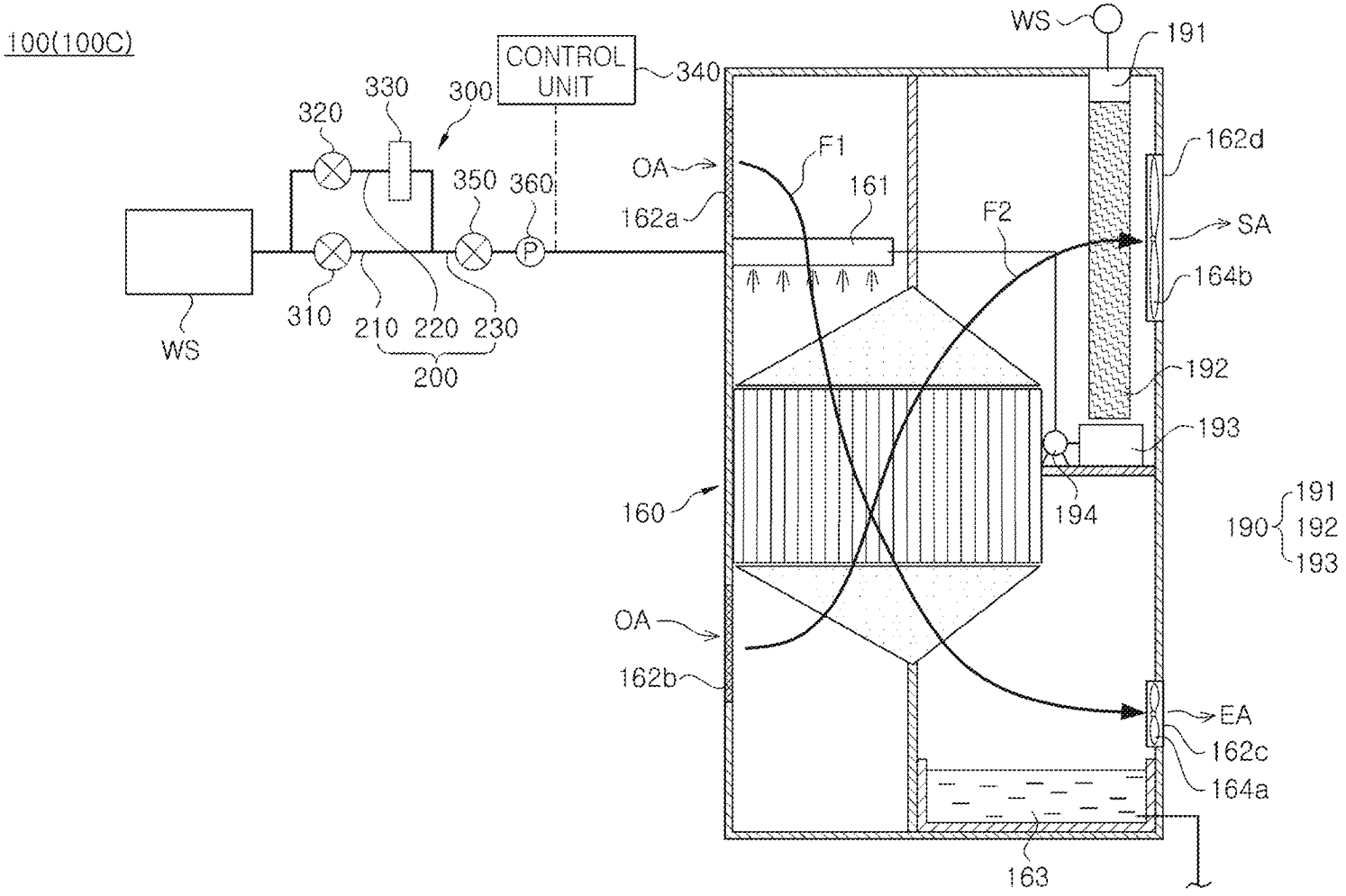
FIG. 3 is a diagram illustrating an air conditioner according to a third embodiment of the present disclosure.

FIG. 3 is a diagram illustrating an air conditioner according to a third embodiment. Hereinafter, an air conditioner 100C according to a third embodiment will be described with reference to FIG. 3, and the air conditioner 100C according to the third embodiment may include components corresponding to those of the air conditioners 100A and 100B according to the first and second embodiments, and the corresponding components will be described by being denoted by the same terms and reference numerals, and overlapping descriptions will not be provided and differences therebetween will be mainly described.

As illustrated in FIG. 3, the air conditioner 100C according to the third embodiment may include an evaporative cooler 160, and a plurality of passages F1 and F2 may be formed therein. In this case, the evaporative cooler 160 may include a plurality of dry channels and a plurality of wet channels which may be alternately and repeatedly disposed therein, and may include a cooler water module 161 providing water to the wet channels. Air requiring cooling may pass through the dry channel, and water sprayed from the cooler water module 161 may evaporate in the wet channel and may exchange heat with the dry channel. Also, as illustrated in FIG. 3, the air conditioner 100C may further include a gas-liquid contact unit 190, but an embodiment thereof is not limited thereto as long as the passage passing through the evaporative cooler 160 may be supplied indoors.

Also, in the evaporative cooler 160, a tank 163 may be provided in a region below the wet channel, and the water collected in the tank 163 may be drained. FIG. 3 illustrates that the water drained from the tank 163 is not circulated, but the water may be connected to the cooler water module 161 and may recirculated. Also, the water supplied to the gas-liquid contact unit 190 may be supplied to the cooler water module 161 of the evaporative cooler 160 by the pump 194 after heat exchange with air and evaporation, and after the water passes through the evaporative cooler 160, the water may be drained from the tank 163.

The gas-liquid contact unit 190 may include a water supply unit 191 disposed in an upper portion, a contact body 192 and a water storage unit 193 disposed in a lower portion, and the contact body 192 may be a structure formed of plastic and/or paper allowing water to flow along the surface. The gas-liquid contact unit 190 may be configured to, when the water supplied to the water supply unit 191 from the water supply source WS flows down along the contact body 192, cool air passing therethrough while the water is vaporized by the air passing through the contact body 192. In this case, water flowing down the contact body 192 due to a weight thereof may be collected in the water storage unit 193, and the water collected in the water storage unit 193 may be supplied to the cooler water module 161 by a pump 194. However, an embodiment thereof is not limited thereto, although not illustrated in the drawing, the pump 194 may be connected to the water storage unit 193 and tank 163, and the water discharged from the water storage unit 193 and tank 163 may be supplied to the cooler water module 161 and the water supply unit 191 by the pump 194.

The plurality of passages F1 and F2 may include a first passage F1 passing through the wet channel of the evaporative cooler 160 and a second passage F2 passing through the dry channel of the evaporative cooler 160, and the second passage F2 may pass through the dry channel and the gas-liquid contact unit 190 in sequence. In this case, water sprayed or supplied from the cooler water module 161 may meet the air passing through the wet channel and the temperature thereof may be lowered. As the air in the wet channel and the air in the dry channel exchange heat, the temperature of the air in the dry channel may be lowered without changes in absolute humidity. Here, as illustrated in FIG. 3, the evaporative cooler 160 may have a separator wall formed therein to separate the air flow without mixing the first passage F1 and second passage F2, and a plurality of inlet ports 162*a* and 162B and a plurality of outlet ports 162*c* and 162*d* may be formed. However, when the evaporative cooler 160 may form passages through the wet channel and dry channel, other passages other than the first passage F1 and second passage F2 may be formed, and the position and shape of the separator wall are not limited thereto.

Outside air OA may enter the first passage F1 through the inlet ports 162A, and the air may pass through the wet channel of the cooler water module 161 of the evaporative cooler 160, and may be exhausted EA through the outlet port 162C. The air flow of the first passage F1 may be formed by the fan 164A disposed in the outlet port 162C, but the position of the fan 164A is not limited to the outlet port 162C, and the air flow may be formed in any position on the first passage F1.

Outdoor air OA may enter the second passage F2 through inlet ports 162B different from the inlet ports 162A, may pass through the dry channel of the evaporative cooler 160, may pass through the gas-liquid contact unit 190, and may be supplied SA to a room or a desired space. The air flow of the second passage F2 may be formed by the fan 164B disposed in the air supply outlet port 162*d*, but the position of the fan 164B is not limited to the outlet port 162*d*, and may be formed in any position on the second passage F2.

The air conditioner 100C according to the third embodiment may include a water supply line 200 for transferring water supplied from a water supply source WS to the evaporative cooler 160 and a water control module 300 for controlling the water supply line 200. The water supply line 200 and the water control module 300 may correspond to the components of the air conditioners 100A and 100B according to the aforementioned first and second embodiments, and in the air conditioner 100C according to the third embodiment, the third water line 230 may be supplied to the cooler water module 161 and may supply water to the evaporative cooler 160.

That is, when the driving of the air conditioner 100C starts, the control unit 340 may open the first control valve 310, and accordingly, water may be supplied to the air conditioner 100C from the water supply source WS through a first water line 210 and a third water line 230, and the water may be supplied to the evaporative cooler 160 through the cooler water module 161.

Meanwhile, when the driving of the air conditioner 100B ends, the control unit 340 may close the first control valve 310 and may open the second control valve 320, and accordingly, water may be supplied to the air conditioner 100C from the water supply source WS through the second water line 220 and the third water line 230, the water may pass through the water filter 330 installed in the second water line 220, and the filtered water may be supplied to the evaporative cooler 160 through the cooler water module 161, and the filtered water may wash foreign substances such as $CaCO_3$ and $MgCO_3$ clogging the water nozzle (not illustrated) of the cooler water module 161 (not illustrated) and may flow down together with the foreign substances.

Furthermore, as illustrated in FIG. 3, in the air conditioner 100C according to the third embodiment, the water control module 300 may further include a pressure reducing valve 350 and a pressure gauge 360. The pressure reducing valve 350 may be installed in the third water line 230 and may adjust pressure of water passing through the third water line 230 to a reference pressure determined by a user, and the pressure gauge 360 may measure pressure of water passing through the third water line 230. In this case, the reference pressure may refer to an amount at which the water supplied to the water nozzle (not illustrated) through the water supply line 200 may be appropriately sprayed, and may refer to a pressure at which fine spraying may be possible. Accordingly, cleaning of the water nozzle (not illustrated) may be easily performed by controlling the filtered water to an appropriate pressure without damaging the water nozzle (not illustrated).

Accordingly, the driving of the air conditioner 100C ends, and as the cleaning process of the water nozzle (not illustrated) of the evaporative cooler 160 is performed once more, the water supply angle and the water flow rate for fine spraying may be maintained to be constant, and durability of the water nozzle (not illustrated) may be improved. In this case, the water nozzle (not illustrated) may be applied to both the evaporative condenser 110 and the evaporative cooler 160, and but an embodiment thereof is not limited thereto as long as the water is finely sprayed.

In the air conditioner 100 according to an embodiment, a flowmeter (not illustrated) may be installed instead of the pressure gauge 360, and a cleaning method of the water nozzle (not illustrated) to be described later may be applied to the control unit 340 by the flowmeter (not illustrated). Hereinafter, a water nozzle cleaning method of the air conditioner 100 according to an embodiment will be described based on the pressure gauge 360, but the flowmeter (not illustrated) may be applied instead of the pressure gauge 360.

Figure 4:
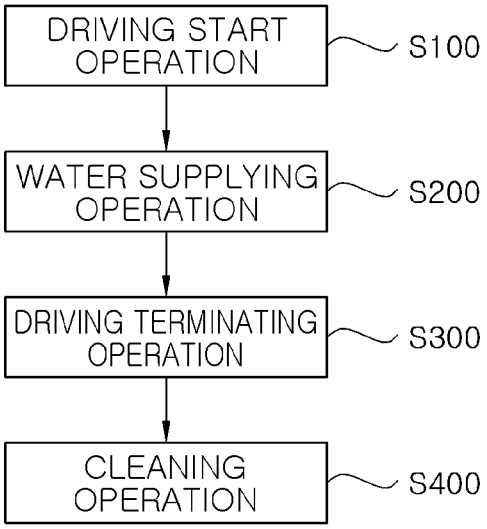
FIG. 4 is a flowchart illustrating a water nozzle cleaning method according to an embodiment of the present disclosure.
Figure 5:
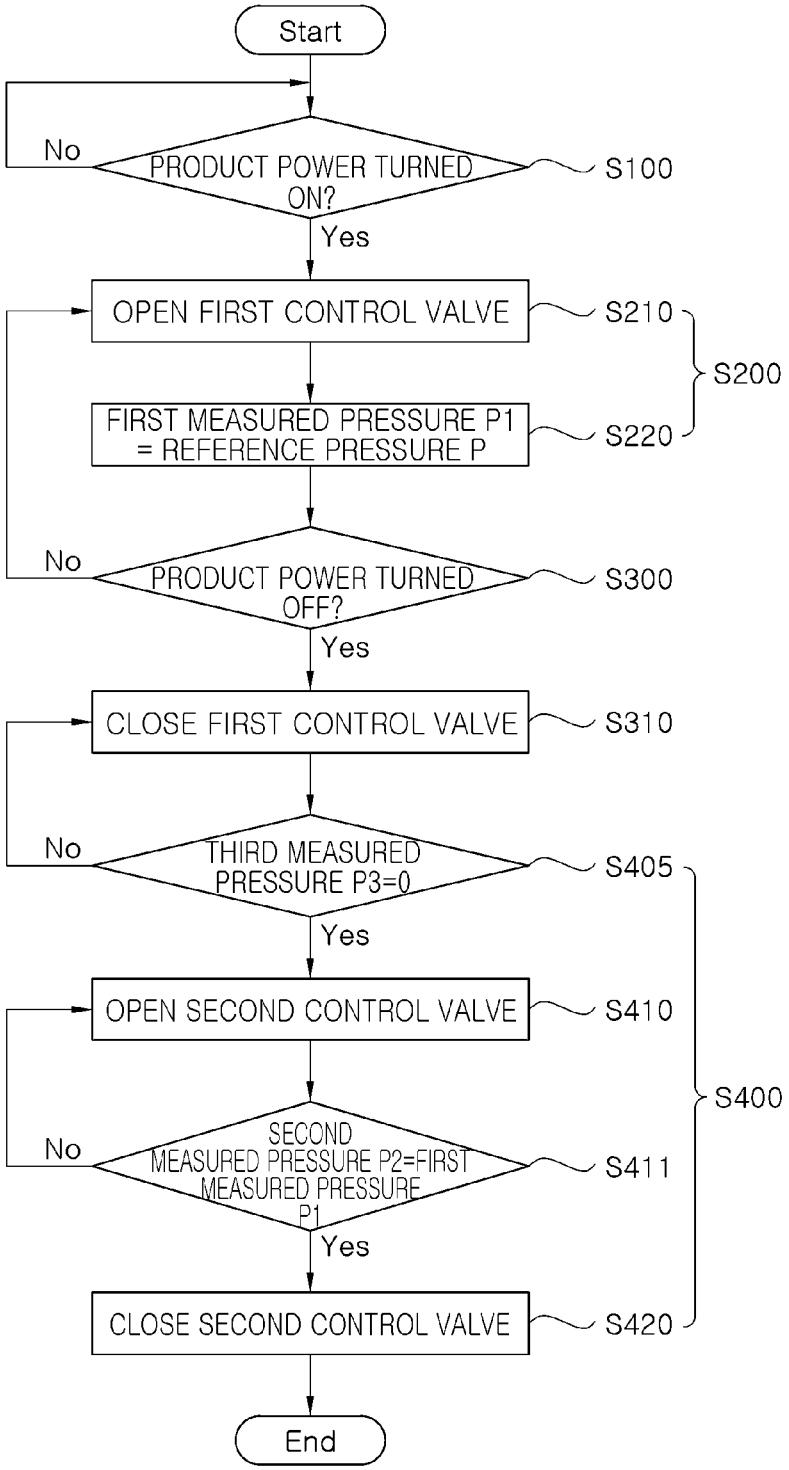
FIG. 5 is a flowchart illustrating a water nozzle cleaning method according to a first embodiment of the present disclosure.
Figure 6:
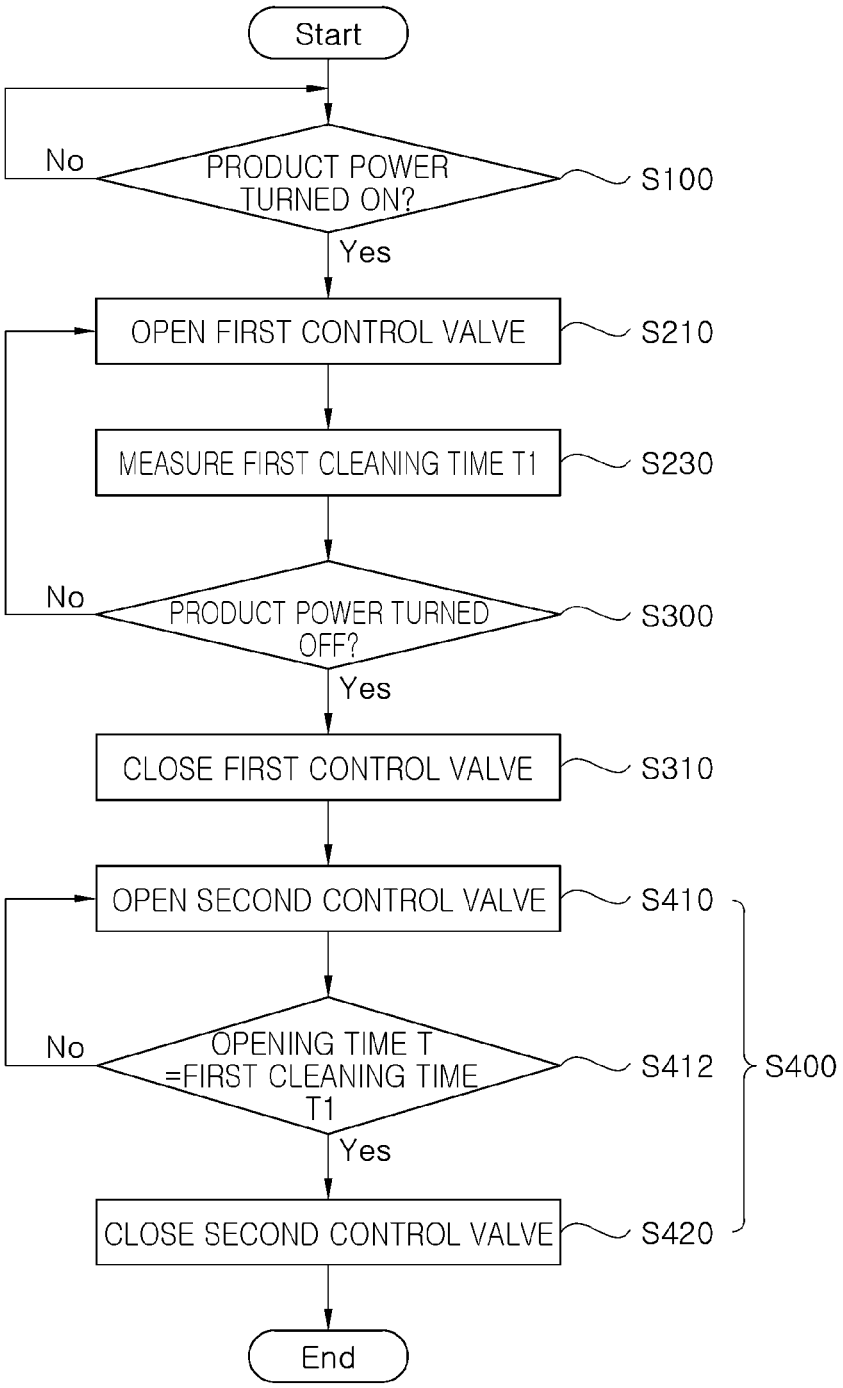
FIG. 6 is a flowchart illustrating a water nozzle cleaning method according to a second embodiment of the present disclosure.
Figure 7:
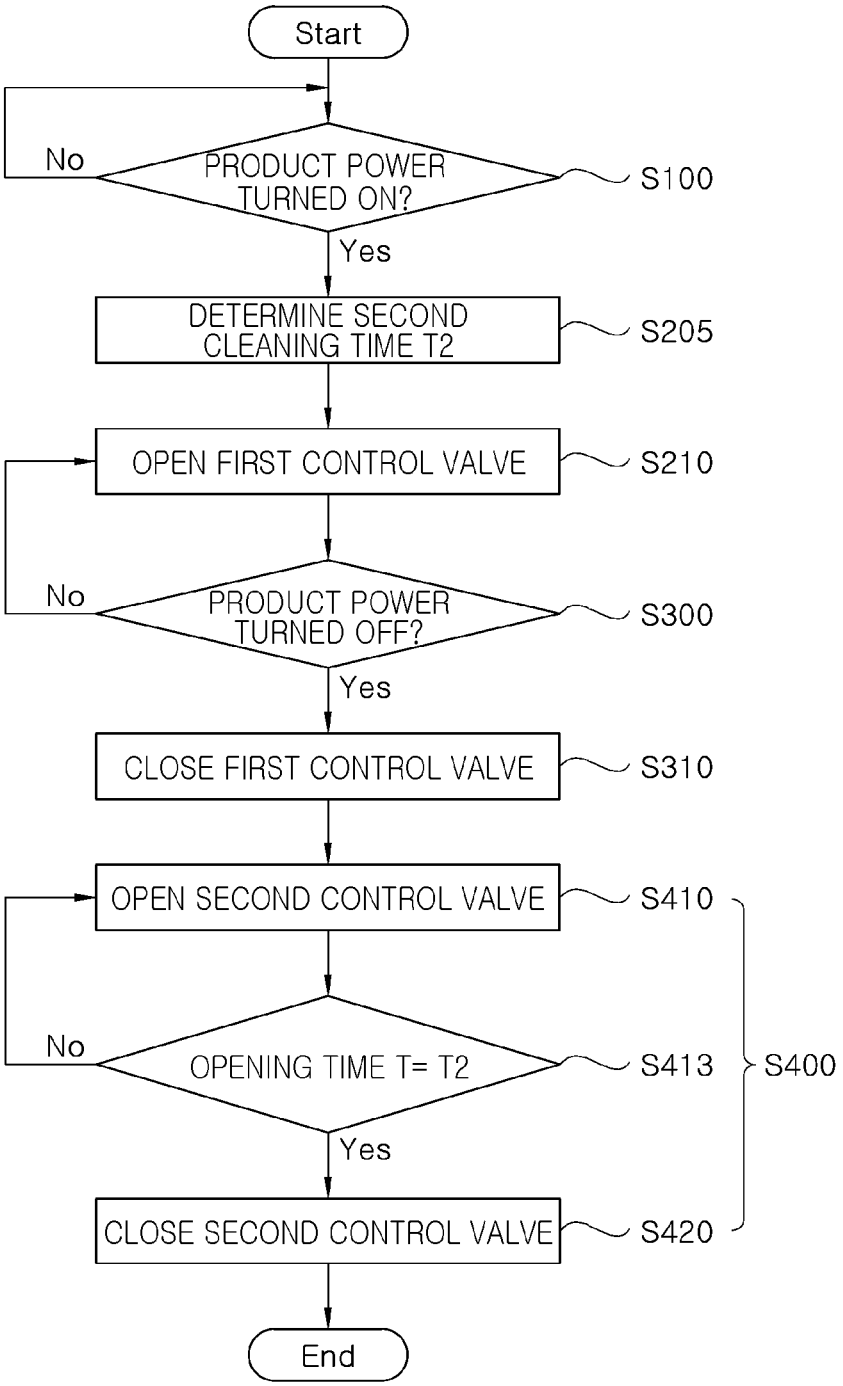
FIG. 7 is a flowchart illustrating a water nozzle cleaning method according to a third embodiment of the present disclosure.

FIGS. 4 to 7 illustrate a water nozzle cleaning method of an air conditioner 100 (see FIGS. 1 and 2) according to an embodiment. FIG. 4 is a flowchart illustrating a water nozzle cleaning method according to an embodiment. FIG. 5 is a flowchart illustrating a water nozzle cleaning method according to a first embodiment. FIG. 6 is a flowchart illustrating a water nozzle cleaning method according to a second embodiment. FIG. 7 is a flowchart illustrating a water nozzle cleaning method according to a third embodiment. Here, the water nozzle cleaning method may be applied to both the air conditioner (100A, see FIG. 1) according to the aforementioned first embodiment, the air conditioner (100B, see FIG. 2) according to the second embodiment, and the air conditioner (100C, see FIG. 3) according to the third embodiment, and may be applied to air conditioners having corresponding components without being limited thereto. Hereinafter, the method will be described by being applied to the air conditioners 100A, 100B, and 100C according to an embodiment, and the water nozzle cleaning method will be described with reference to FIGS. 1 to 7.

The water nozzle cleaning method according to an embodiment may include a driving starting operation S100, a water supplying operation S200, a driving terminating operation S300 and a cleaning operation S400. The driving starting operation S100 may include starting driving when the power of the air conditioner 100 is turned on, and the water supplying operation S200 may include an operation S210 of opening the first control valve 310, and accordingly, water supplied from the water supply source WS to the first water line 210 and the third water line 230 may be sprayed to the heat exchanger through a water nozzle (not illustrated). The driving terminating operation S300 may further include an operation S310 of terminating driving by turning off power of the air conditioner 100 and closing the first control valve 310. The cleaning operation S400 may include an operation S410 of opening the second control valve 320, and accordingly, the water supplied from the water supply source WS to the second water line 220 may be purified by passing through the water filter 330, and the filtered water may be sprayed to the heat exchanger through the third water line 230 and a water nozzle (not illustrated). Also, the cleaning operation S400 further may include an operation S420 of closing the second control valve 320 after the cleaning is completed.

Here, the heat exchanger may refer to the evaporative condenser 110 in the air conditioner 100A according to the aforementioned first embodiment, may refer to the evaporative condenser 110 and the evaporative cooler 160 in the air conditioner 100B according to the aforementioned second embodiment, may refer to the evaporative cooler 160 according to the aforementioned third embodiment. An embodiment thereof is not limited thereto as long as the heat exchanger may be implemented as a device which may exchange heat between water and air sprayed through the water nozzle (not illustrated).

As illustrated in FIG. 5, according to the water nozzle cleaning method according to the first embodiment, the water supplying operation S200 may further include a first measuring operation S220 of measuring and storing the pressure when the first measured pressure P1, the pressure of the water moving toward the water nozzle (not illustrated) with the pressure gauge 360, reaches the reference pressure P. The reference pressure P may be a pressure appropriately determined for fine spraying and may be controlled by the pressure reducing valve 350. For example, the reference pressure P may be 2.5 kgf/cm$^2$.

Furthermore, in the cleaning operation S400, the second control valve 320 may be opened in operation S410 of opening the second control valve 320, and the pressure gauge 360 may measure the second measured pressure P2, the pressure of the filtered water moving to the water nozzle (not illustrated) side. The cleaning operation S400 may further include a first cleaning operation S411 for measuring pressure P2 and cleaning until the first measured pressure P1 and the second measured pressure P2 are equalized.

More specifically, referring to FIGS. 1 to 3, in the first measuring operation S220, after the pressure gauge 360 opens the first control valve 310, the pressure when the first measured pressure P1, the pressure of the water passing through the first water line 210 and the third water line 230, reaches the reference pressure P of the pressure reducing valve 350 may be measured and stored. Thereafter, in the first cleaning operation S411, the pressure gauge 360 may pass through the second water line 220 and the third water line 230 and may measure the second measured pressure P2, the pressure of the filtered water, and when the second measured pressure P2 reaches the first measured pressure P1 stored in the pressure gauge 360, the second control valve 320 may be closed by the control unit 340.

Furthermore, the cleaning operation S400 may further include a residual water treatment operation S405, and in the residual water treatment operation S405, the pressure gauge 360 may measure a third measured pressure P3, the pressure of residual water moving to the water nozzle (not illustrated) side after the driving terminating operation S300, and after the third measured pressure P3 reaches 0 kgf/cm$^2$, operation S410 of opening the second control valve may start. For example, when the third measured pressure P3, the pressure of the residual water passing through the third water line 230, reaches 0 kgf/cm$^2$ after the first control valve 310 is closed, the control unit 340 may open the second control valve 320.

Also, although not illustrated in FIG. 5, the cleaning operation S400 may further include a stabilization operation (not illustrated) including a stabilization time of a predetermined period of time of 20 seconds or less after the first cleaning operation S411. For example, the control unit 340 may end the first cleaning operation S411 by closing the second control valve 320 after the second measured pressure P2 reaches the stored first measured pressure P1. That is, as compared to the water supplying operation S200, the cleaning operation S400, the cleaning operation S400 may further include a predetermined period of time of 20 seconds or less until the third water line 230 is stabilized by the pressure reducing valve 350 even when the second measured pressure P2 reaches the first measured pressure P1.

As illustrated in FIG. 6, according to the water nozzle cleaning method according to the second embodiment, the water supplying operation S200 may further include a second measuring operation S230 of measuring the first measured pressure P1, the pressure of the water moving to the water nozzle (not illustrated) side, with the pressure gauge 360, and measuring the first cleaning time T1, the time at which the first measured pressure P1 reaches the reference pressure P determined by the user. That is, differently from measuring the pressure in the first measuring operation S220 (see FIG. 4), the first cleaning time T1 may be measured in the second measuring operation S230. In this case, the cleaning operation S400 may include an operation S410 of opening the second control valve 320, and may further include a second cleaning operation S412 of opening the second control valve 320 during the first cleaning time T1.

More specifically, referring to FIGS. 1 to 3, in the second measuring operation S230, the pressure gauge 360 may measure the first measured pressure P1, the pressure of the water passing through the first water line 210 and the third water line 230 after the first control valve 310 is opened, and the control unit 340 may measure a first cleaning time T1, the time at which the first measured pressure P1 reaches the reference pressure P. Thereafter, after the first control valve 310 is closed, the second control valve 320 may be opened during the first cleaning time T1. Accordingly, the opening time T of the second control valve 320 may be equal to the first cleaning time T1.

In this case, the water supplying operation S200 may further include a stabilization operation (not illustrated) including a stabilization time of a predetermined period of time of 20 seconds or less after the first cleaning time T1. For example, the control unit 340 may open the second control valve 320 and may close the second control valve 320 after a predetermined period of time of 20 seconds or less has elapsed after the first cleaning time T1 has passed. That is, as compared to the cleaning operation S400, the water supplying operation S200 may further include a predetermined period of time of 20 seconds or less until stabilization by the pressure reducing valve 350 even when the first measured pressure P1 reaches the reference pressure P.

As illustrated in FIG. 7, according to the water nozzle cleaning method according to the third embodiment, the water supplying operation S200 may further include a setting operation S205 for determining a second cleaning time T2. In this case, the second $$T2 = \frac{V * p + \frac{\pi}{4} D^2 * l}{1000} \times \frac{1}{lps},$$

cleaning time T2 may satisfy equation where T2 is a second cleaning time (sec), l is a piping length (cm), D is a piping diameter (cm), V is a water pipe volume (cm$^3$), p is the number of water pipes, lps is a rate of supplying direct water (L/sec). Thereafter, the cleaning operation S400 may include an operation S410 of opening the second control valve 320, and may further include a third cleaning operation S413 of opening the second control valve 320 during the second cleaning time T2.

More specifically, in the setting operation S205, the control unit 340 may determine and store a second cleaning time T2 satisfying the equation as the user inputs variables, and in the third cleaning operation S413, the control unit 340 may open the second control valve 320 during the second cleaning time T2. That is, the opening time T of the second control valve 320 may be the same as the second cleaning time T2.

The water nozzle cleaning method according to the first embodiment described above may control the water supplying time and the cleaning time by pressure, and may have a stabilization time of a predetermined period of time of 20 seconds or less in the cleaning operation S400. As the water nozzle cleaning method according to the above-described second embodiment determines the first cleaning time T1, water supplying time and cleaning time may be performed during the first cleaning time T1, and a stabilization time may be provided in the water supplying operation S200. Also, in the water nozzle cleaning method according to the third embodiment described above, without the pressure reducing valve 350 and the pressure gauge 360, the user may input variables such as a piping length and a piping diameter according to the place in which the conditioner is used, such that the second cleaning time T2 is may be determined, and the cleaning operation S400 may be performed during the second cleaning time T2.

According to the water nozzle cleaning method according to an embodiment, automation and stable operation of the water nozzle (not illustrated) cleaning may be obtained, the consumption of the water used for cleaning the water nozzle (not illustrated) may be saved and optimized, and consumption efficiency may be obtained. Also, the air conditioner to which the water nozzle cleaning method according to an embodiment is applied may remove foreign substances attached to the water nozzle (not illustrated) and may increase durability as the cleaning of the water nozzle (not illustrated) is performed, and the nozzle angle and the water flow rate may be maintained to be constant.

According to the aforementioned embodiments, using the air conditioner and the water nozzle cleaning method, an air conditioner including a water nozzle cleaning system which may clean the water nozzle for spraying water to the heat exchanger and the water nozzle cleaning method used therein may be provided.

While the embodiments have been illustrated and described above, it will be apparent to those skilled in the art that modifications and variations could be manufactured without departing from the scope of the present disclosure as defined by the appended claims.

What is claimed is:

1. An air conditioner including a heat exchanger, the air conditioner comprising:

a water supply line including a first water line and a second water line branching from a water supply source and a third water line to which the first water line and the second water line are joined, and configured to supply water to the heat exchanger;

and a water supply controller configured to control the water supply line and including a first control valve installed in the first water line, a second control valve installed in the second water line, and a water filter, wherein, the controller is configured to open the first control valve when driving of the air conditioner starts, and to close the first control valve and open the second control valve when driving of the air conditioner ends.

2. The air conditioner of claim 1, wherein the heat exchanger includes an evaporative condenser assembly, and wherein the evaporative condenser assembly includes a condenser including a fluid passage, a water nozzle configured to spray water supplied through the water supply line above the condenser, and a fan disposed on one side of the condenser and configured to provide air passing through the condenser.

3. The air conditioner of claim 1, wherein the heat exchanger includes an evaporative condenser assembly through which refrigerant circulates, and an evaporative cooler disposed on an inlet passage through which outdoor air flows in and providing cooled air to the evaporative condenser assembly, and wherein the air conditioner includes:

a dehumidifying rotor disposed at a particular location of the inlet passage and the regeneration passage; and a heater disposed before the dehumidifying rotor on the regeneration passage and configured to regenerate the dehumidifying rotor by heating air passing through the regeneration passage, wherein the evaporative condenser assembly includes a condenser including a fluid passage, a water nozzle configured to spray water supplied through the water supply line above the condenser, and a fan disposed on one side of the condenser and configured to provide air passing through the condenser, and wherein the evaporative cooler includes a dry channel through which the air passing through the dehumidifying rotor passes, a wet channel disposed to exchange heat with the dry channel, and a cooler nozzle configured to provide water to the wet channel.

4. The air conditioner of claim 1, wherein the heat exchanger includes:

an evaporative cooler in which a plurality of dry channels and a plurality of wet channels are alternately and repeatedly disposed and a cooler nozzle configured to provide water to the wet channel, and wherein the evaporative cooler includes a first passage passing through the wet channel and a second passage passing through the dry channel.

5. The air conditioner of claim 1, wherein the water supply controller includes:

a pressure reducing valve installed in the third water line and configured to adjust pressure of water passing through the third water line to a reference pressure determined by a user; and a pressure gauge configured to measure pressure of water passing through the third water line.

6. The air conditioner of claim 5, wherein, after the first control valve is opened, the pressure reducing valve controls a first measured pressure, the pressure of unfiltered water passing through the first water line and subsequently through the third water line, to be the reference pressure, and wherein the pressure gauge measures and stores the first measured pressure reaching the reference pressure, closes the first control valve, and after the second control valve is opened, the pressure gauge measures a second measured pressure, the pressure of filtered water passing through the second water line and the water filter and subsequently through a third water line, and wherein, the controller is configured to close the second control valve, when the second measured pressure reaches the stored first measured pressure.

7. The air conditioner of claim 6, wherein, the controller is configured to open the second control valve, after the first control valve is closed, when a third measured pressure, the pressure of residual water passing through the third water line, reaches 0 $kgf/cm^2$.

8. The air conditioner of claim 7, wherein, the controller is configured to close the second control valve, after a predetermined period of time of 20 seconds or less has elapsed since the second measured pressure reaches the stored first measured pressure.

9. The air conditioner of claim 5, wherein, after the first control valve is opened, the pressure gauge measures a first measured pressure, the pressure of the water passing through the first water line and subsequently through the third water line, and wherein the controller measures a first cleaning time, the time at which the first measured pressure reaches the reference pressure, and the controller closes the first control valve, and opens the second control valve during the first cleaning time.

10. The air conditioner of claim 9, wherein, after the first cleaning time has elapsed since opening the second control valve is opened, the controller closes the second control valve after a predetermined period of time of 20 seconds or less elapses.

11. The air conditioner of claim 1, wherein, the controller is configured to determine a cleaning time satisfying an equation as below, when driving of the air conditioner starts, wherein, the controller is configured to close the first control valve, and open the second control valve during the cleaning time, when driving of the air conditioner ends:

$$T2 = \frac{V * p + \frac{\pi}{4} D^2 * l}{1000} \times \frac{1}{lps} \quad \text{Equation}$$

where T2 is the cleaning time (sec), l is a piping length (cm), D is a piping diameter (cm), V is a water pipe volume ($cm^3$), p is the number of water pipes, lps is a rate of supplying direct water (L/sec).

12. A water nozzle cleaning method, comprising:

a driving starting operation of starting driving of the air conditioner;

a water supplying operation of spraying water through a water nozzle to a heat exchanger;

a driving terminating operation of terminating driving of the air conditioner; and a cleaning operation of spraying filtered water to the heat exchanger through the water nozzle by passing through a water filter, wherein the water supplying operation includes measuring and storing a first measured pressure, the pressure of unfiltered water passing through a first water line and subsequently through a third water line, with a pressure gauge, and wherein the cleaning operation includes measuring a second measured pressure, the pressure of the filtered water passing through a second water line and a water filter and subsequently through a third water line, with the pressure gauge, and the cleaning operation is performed until the first measured pressure and the second measured pressure are equalized.

13. The water nozzle cleaning method of claim 12, wherein the cleaning operation includes measuring a third measured pressure, the pressure of the residual water passing through a first water line and subsequently through a third water line after the driving terminating operation with the pressure gauge, and starts after the third measured pressure reaches 0 $kgf/cm^2$.

14. The water nozzle cleaning method of claim 12, wherein, after the first measured pressure and the second measured pressure are equalized, the cleaning operation is further performed for a predetermined period of time of 20 seconds or less.

15. The water nozzle cleaning method of claim 12, wherein the cleaning operation is performed during a cleaning time satisfying an equation below:

$$T2 = \frac{V * p + \frac{\pi}{4} D^2 * l}{1000} \times \frac{1}{lps} \quad \text{Equation}$$

where T2 is the cleaning time (sec), l is a piping length (cm), D is a piping diameter (cm), V is a water pipe volume ($cm^3$), p is the number of water pipes, lps is a rate of supplying direct water (L/sec).

16. A water nozzle cleaning method, comprising:

a driving starting operation of starting driving of the air conditioner;

a water supplying operation of spraying water through a water nozzle to a heat exchanger;

a driving terminating operation of terminating driving of the air conditioner; and a cleaning operation of spraying filtered water to the heat exchanger through the water nozzle by passing through a water filter, wherein the water supplying operation includes measuring a first measured pressure, the pressure of the water passing through a first water line and subsequently through a second water line, with a pressure gauge, and the water supplying operation is performed during a first cleaning time, the time at which the first measured pressure reaches reference pressure determined by a user, and wherein the cleaning operation is performed for the first cleaning time.

17. The water nozzle cleaning method of claim 16, wherein the water supplying operation is performed for a predetermined period of time of 20 seconds or less after the first cleaning time.

18. The water nozzle cleaning method of claim 16, wherein the cleaning operation is performed during a second cleaning time satisfying an equation below:

$$T2 = \frac{V * p + \frac{\pi}{4} D^2 * l}{1000} \times \frac{1}{lps} \quad \text{Equation}$$

where T2 is the second cleaning time (sec), l is a piping length (cm), D is a piping diameter (cm), V is a water pipe volume ($cm^3$), p is the number of water pipes, lps is a rate of supplying direct water (L/sec).

* * * * *